United States Patent [19]

Membrino

[11] Patent Number: 4,468,276

[45] Date of Patent: Aug. 28, 1984

[54] BAG PAD BINDER

[76] Inventor: Hercules Membrino, 280 Paoli Pike, Malvern, Pa. 19355

[21] Appl. No.: 474,722

[22] Filed: Mar. 11, 1983

[51] Int. Cl.[3] ..... B32B 31/18

[52] U.S. Cl. ..... 156/510; 156/251; 156/290; 156/308.4; 156/513; 156/515; 156/530; 206/554; 493/204; 493/209

[58] Field of Search ..... 156/252, 253, 290, 304.1, 156/304.6, 306.3, 308.4, 379.8, 379.9, 510, 513, 515, 518, 530; 53/158, 531; 206/526, 554; 493/186, 189, 198, 204, 209

[56] References Cited

U.S. PATENT DOCUMENTS

| | | | |
|---|---|---|---|
| 3,021,947 | 2/1962 | Sylvester et al. | 156/308.4 |
| 3,966,524 | 6/1976 | Lehmacher | 156/290 |
| 4,046,257 | 9/1977 | Lehmacher | 206/554 |
| 4,128,049 | 12/1978 | Lehmacher | 493/204 |
| 4,261,780 | 4/1981 | Yanai | 156/513 |
| 4,305,503 | 12/1981 | Membrino | 206/554 |
| 4,392,906 | 7/1983 | Hara | 156/510 |
| 4,406,371 | 9/1983 | Membrino | 206/554 |

*Primary Examiner*—Caleb Weston

*Attorney, Agent, or Firm*—Arthur A. Jacobs

[57] ABSTRACT

A binding machine for binding together a stack of individual bags to form a pad by connecting the bags together at the overlapping selvage portions thereof adjacent their mouths, comprising a vertically movable actuating means having a cutting means and side sealing means operatively connected thereto, whereby as the actuating means moves toward a platform adapted to support a stack of bags, the cutting means and the side sealing means move together to both perforate and form side seals at the overlapping selvage portions of the bags, the machine also being provided with end sealing means that are optionally operated in conjunction with the vertically movable actuating means to form end seals on the selvage portions of the stack of bags.

14 Claims, 11 Drawing Figures

FIG. 1
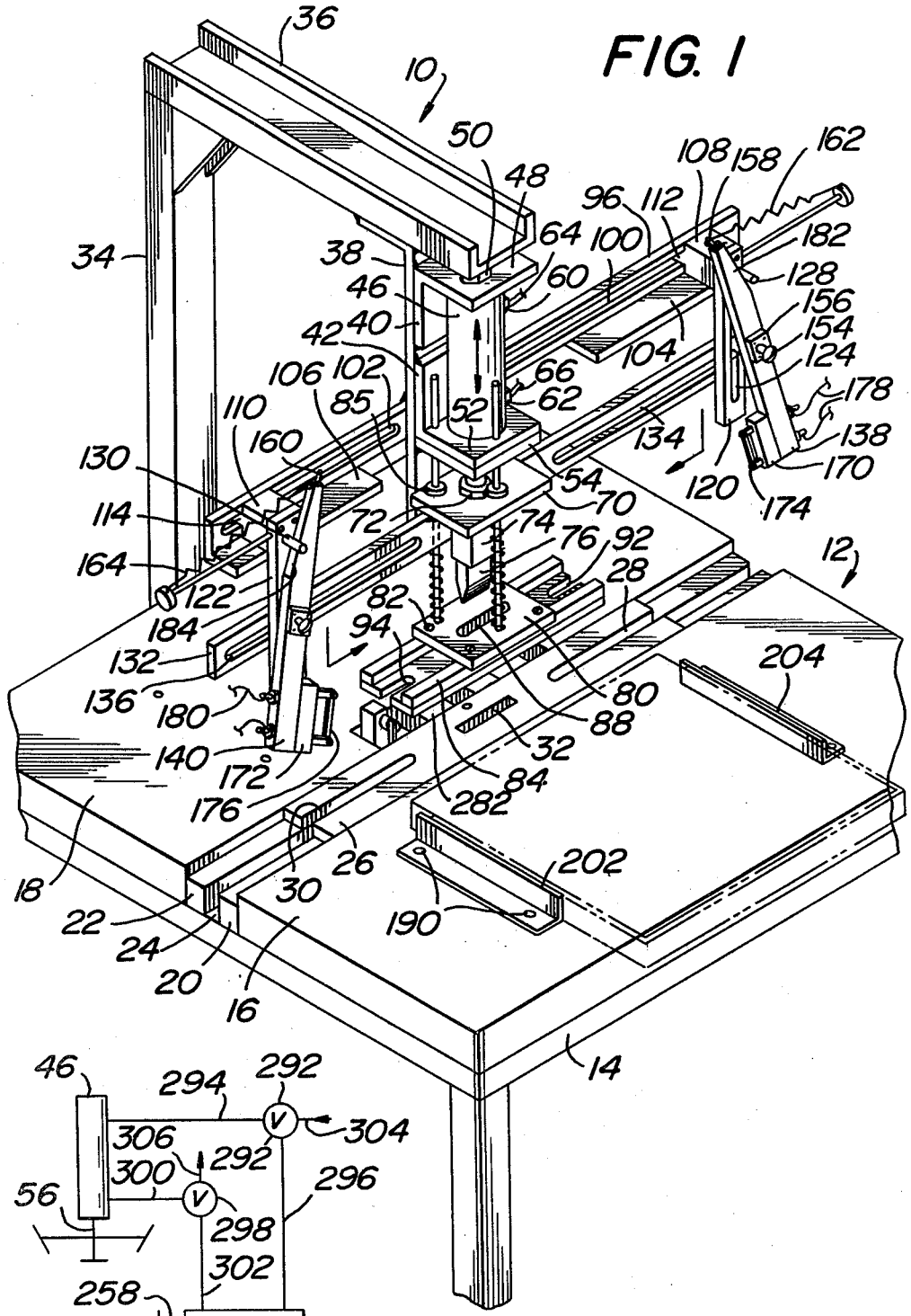
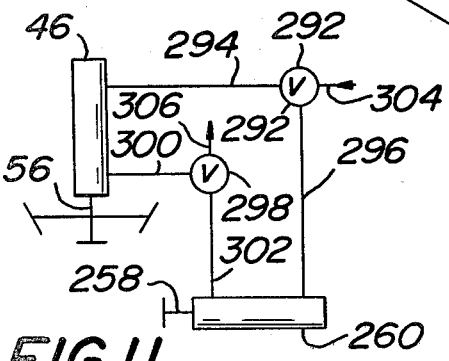
FIG. 11

FIG. 2
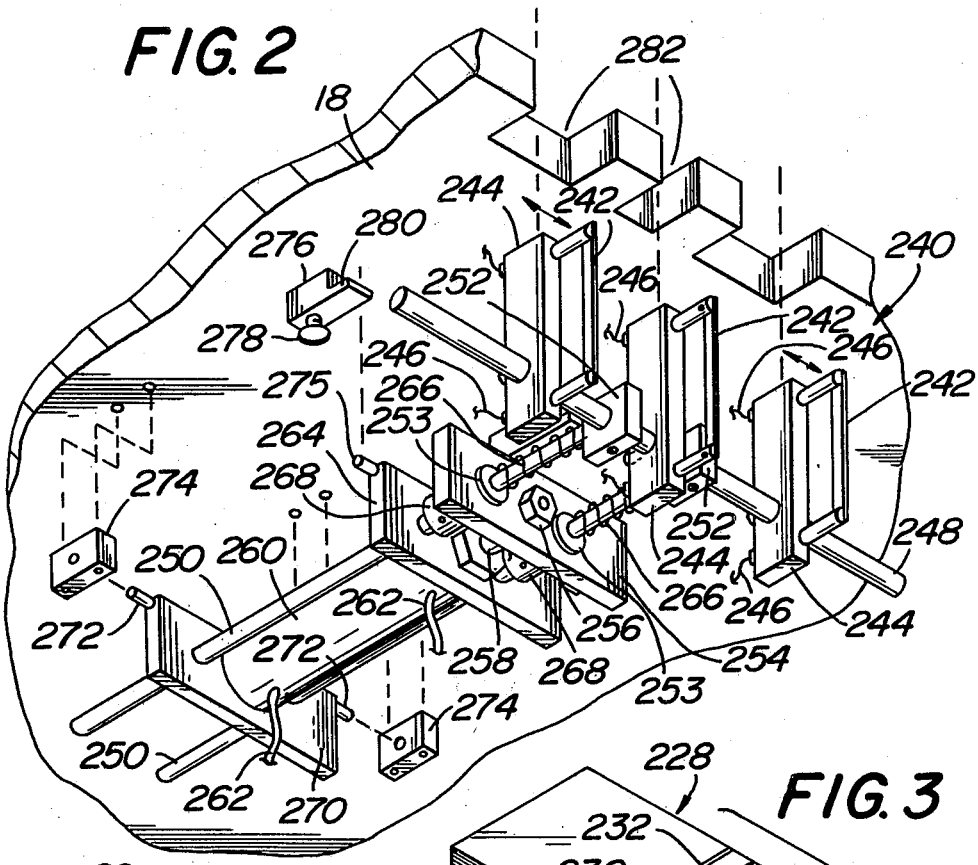
FIG. 3
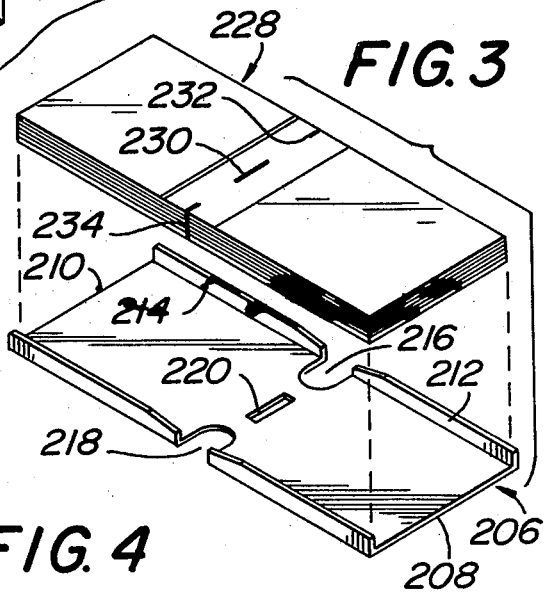
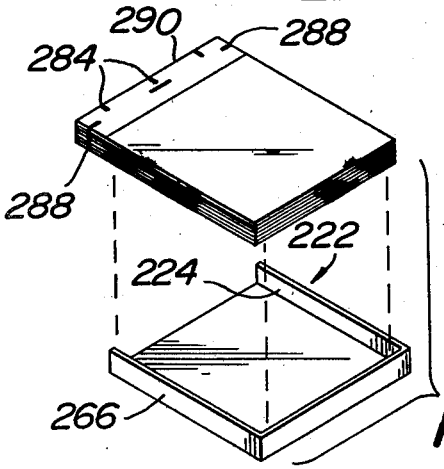
FIG. 4

FIG. 9
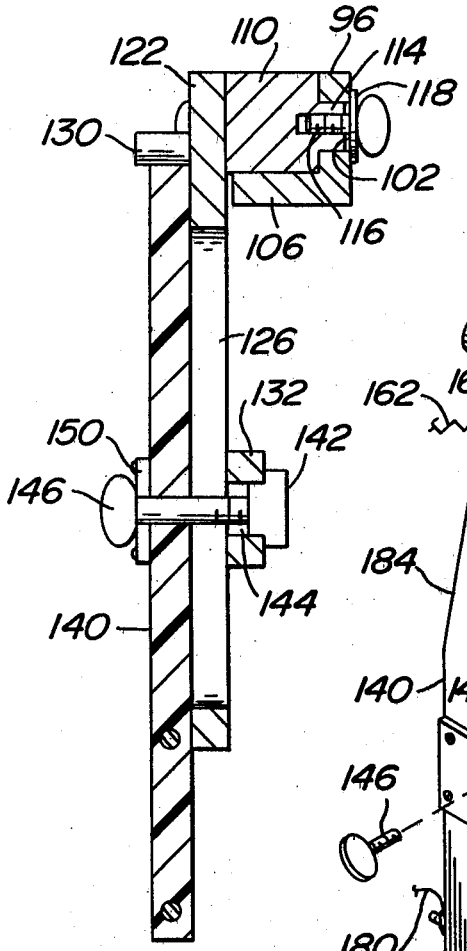
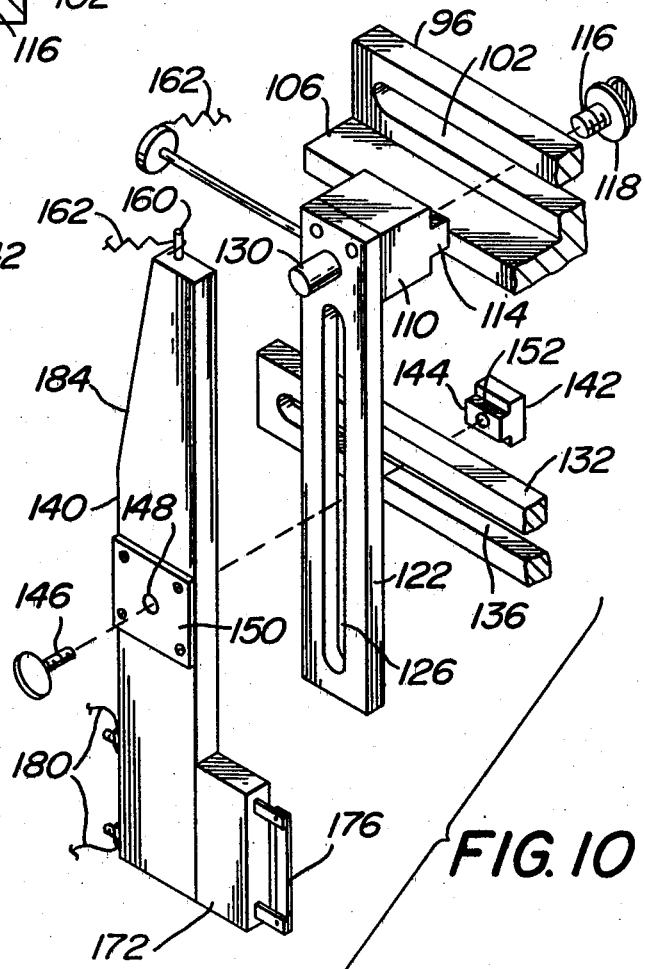
FIG. 10

BAG PAD BINDER

This invention relates to a machine for binding bags, and it particularly relates to a machine for binding individual plastic bags together to form a pad.

Pads of plastic bags, which are substantially self-contained or self-supportive, are becoming increasingly popular. Such pads comprise a plurality of bag units, overlaid one upon the other. Each unit comprises a pocket having sealed edges at its entire perimeter except at one edge where there is an opening forming a mouth. The units may be of the single bag type having individual pockets which are sealed or otherwise connected at a selvage portion extending beyond the mouths of the pockets, or they may be of the double bag type where each unit comprises a pair of opposed pockets integrally joined together by a common selvage portion or spacer extending beyond the mouths of the joined bags and positioned therebetween.

In both types of bags the selvage portion is provided with a longitudinal score line extending from one end to the other thereof whereby, when the front wall of a pocket is pulled forwardly toward the user, the pocket will be severed from the selvage portion at the score line and form a bag. In the single bag type, there is only one such score line while in the double bag type there are two spaced parallel score lines, one for each of the opposed pockets.

The single bag type is disclosed in co-pending Application Ser. No. 319,639, filed Nov. 9, 1981 and issued as U.S. Pat. No. 4,406,371 on Sept. 27, 1983, and the double bag type is disclosed in U.S. Pat. No. 4,305,503, dated Dec. 15, 1981.

As disclosed both in the aforementioned U.S. Pat. No. 4,305,503 and U.S. Pat. No. 4,406,371, both of which are incorporated herein by reference, a seal is provided at each end of the selvage portion, above the score line in the single bag type and between the parallel score lines in the double bag type, whereby, when the front wall of a pocket is pulled forwardly, these end seals form anchors or counterforces so that the forward pull moves the front wall away from the rear wall of the pocket, thereby opening the mouth of the resultant bag. This is important because thin plastic such as polyethylene or the like, tends to adhere to itself, thereby often making it very difficult to open the bag.

In addition to the above, where double bag type units are concerned, the end seals, namely those at each end of the selvage portion, are sufficient to both form the anchor means and to seal the bag units together to form the pad because the common, or interconnecting, selvage portion or spacer permits the pockets on one side to act as a support while all the pockets are severed on the opposing side. In the single bag type, however, there is preferably provided an additional connection such as one or more lateral seals at the upper edge of the pad.

It is an object of the present invention to provide an apparatus which is adapted to form both single and double bag types of pads of the aforesaid construction by applying end seals and, where required, lateral seals at the upper edges of the pads, in a rapid and easy manner.

Another object of the present invention is to provide an apparatus of the aforesaid type which is relatively simple and compact in construction and relatively inexpensive to manufacture and maintain.

Other objects and many of the attendant advantages of this invention will be readily appreciated as the same becomes better understood by reference to the following description when read in conjunction with the accompanying drawings wherein:

FIG. 1 is a top perspective view, partly broken away, of a machine embodying the present invention.

FIG. 2 is an exploded bottom perspective view of the machine of FIG. 1.

FIG. 3 is an exploded top perspective view of a double bag tray and the double bag pads seated therein after the pads have been sealed.

FIG. 4 is a top perspective view similar to FIG. 3, but showing a single bag pad and tray.

FIG. 9 is a cross-sectional view taken on line 9—9 of FIG. 5.

FIG. 10 is an exploded perspective view of one of the sealing arm assemblies shown in FIG. 1.

FIG. 11 is a schematic view of a fluid circuit for the present invention.

Figure 5:
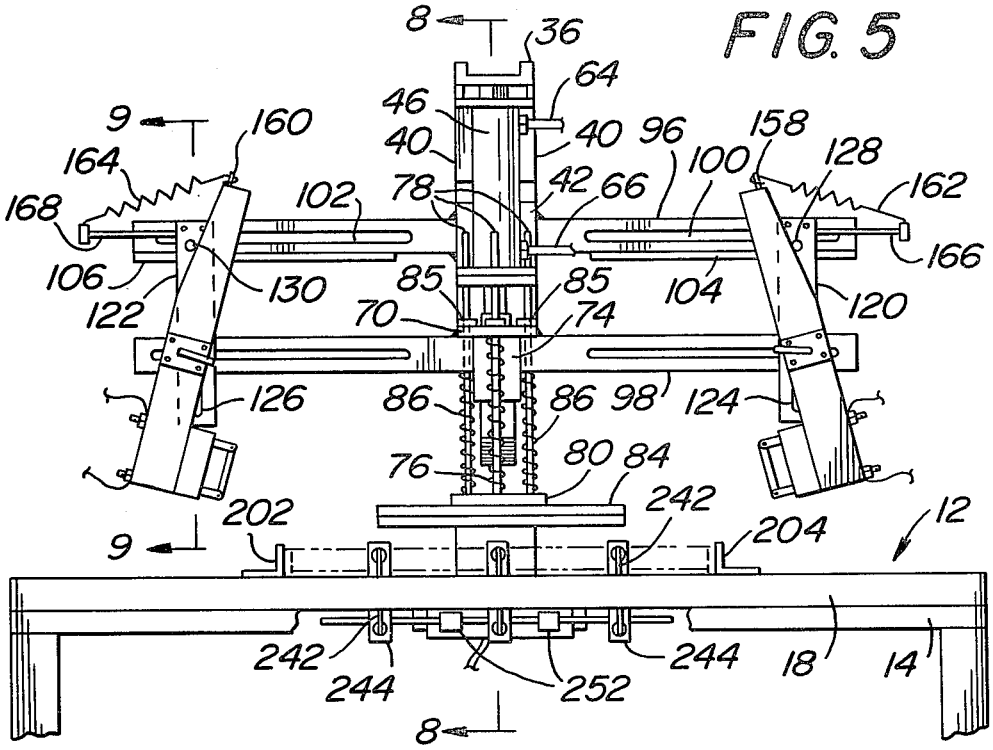
FIG. 5 is a front elevational view of the machine of FIG. 1.

Referring in greater detail to the drawings wherein similar reference characters refer to similar parts, there is shown in FIG. 1 a bag pad binding machine, generally designated 10, comprising a tray support platform, generally designated 12, mounted on table 14, preferably of angle-iron construction.

The tray support platform 12 comprises a pair of tray support panels 16 and 18, each of which has an undercut portion or lateral flange, as at 20 and 22. The flanges 20 and 22 face each other, but are spaced from each other to form a transverse groove 24.

The flanges 20 and 22 support a side seal guide plate 26 between the corresponding edges of the panels 16 and 18. The guide plate 26 is provided with a pair of longitudinally extending slots 28 and 30 which extend from opposite ends of the plate. It is also provided with a central slot 32.

Extending up from the table 14 at one edge thereof, is a post 34 having a horizontal support means or extension 36 at its upper end. Both the post 34 and extension 36 are constructed of angle-iron, but this is generally immaterial to the invention. The extension 36 has a downwardly extending mounting plate 38 to which are connected a pair of brackts 40 and 42. A threaded stud 44 extends from the upper end of a cylinder 46 through an aperture in the horizontal flange 48 of the bracket 40 and is held by a nut 50, which both secures the upper end of the cylinder to the bracket and spaces the bracket from the horizontal extension 36. The lower end of the cylinder 46 is supported by a horizontal flange 52 of the bracket 42 which is connected to a plate 54 attached to the mounting plate 38.

A piston 55 having a piston rod 56 and a piston head 58, is movable within cylinder 36, the cylinder being provided with an upper port 60 above the piston head and a lower port 62 below the piston head, for accommodating respective lines 64 and 66 leading to and from a source of fluid under pressure, not shown.

The piston rod 56 is movable through coaxial apertures in the flange 52 and plate 54, and is provided with a threaded portion 68 to which is threadedly connected a plate 70 held by a nut 72. The piston rod 56 is threadely connected to a rectangular blade holder 74 which holds a slitting blade 76.

Extending through corresponding apertures in the flange 54, plate 56 and plate 70 are rods 78. These rods are fastened to a plate 80, which is connected by screws 82 to a platen 84, and are each provided with a collar 85 adapted to bear against the plate 70. Coil springs 86 encircle the rods 78 between the plate 70 and the plate 80, whereby downward movement of the piston 58, which carries the blade 76, will act against the upward bias of the springs 86. Such downward movement causes the plate 70 to slide down to the rods 78, against the bias of the springs 86. During this motion, the platen 84 bears down on the bags in the tray and is held thereagainst while the blade 76 continues to overtravel the platen to perform its slitting action on the bags. During this overtravel the plate 70 slides on the rods 78, whereby the bag pad is stripped therefrom and is easily removable after completion of the operation.

Both the plate 80 and the platen 84 are provided with corresponding elongated central slots, indicated at 88 and 90 respectively, which are adapted to receive the blade 76 when it descends. The platen 84, which comprises a flat bottom wall having upstanding flanges at its opposite longitudinal edges, is further provided with a slot at each end, indicated at 92 and 94 respectively.

Attached to the mounting plate 38 and extending laterally from each side thereof is a support bar 96. The bar 96 is provided with a pair of opposed elongated slots 100 and 102. At each end portion of the bar 96, partially underlying the corresponding slot 100 or 102, is a lateral flange indicated respectively at 104 and 106. Each lateral flange 104 and 106 supports a block, shown respectively at 108 and 110, and each block has a nose position, shown respectively at 112 and 114, which is adapted to ride in the corresponding slot 100 or 102, but is held in adjustably secured position by a set-screw, such as shown at 116, and a collar, such as shown at 118 (see FIGS. 9 and 10).

Rigidly attached to each block 108, 110 is a guide arm, indicated at 120 and 122 respectively, each having a longitudinal slot, as at 124 and 126 respectively, and a laterally-extending pin above this slot, as at 128 and 130 respectively.

Attached to blade holder 74 is a second or lower support bar 132 having oppositely-disposed elongated slots 134 and 136. A pair of oppositely-disposed heat sealing arms, such as indicated at 138 and 140 respectively, are adjustably fixed to the support bar 132 and slidably connected to the respective guide arms 120 and 122 in the manner best shown in FIG. 10 wherein there is shown a block 142 having a nose portion 144 which is slidably fitted within slot 136. A set screw 146 is inserted through the aperture 148 that extends through the arm 140 and a shim 150 thereon, through the slot 126 in guide arm 122, and into an aperture 152 in the nose portion 144 of block 142, and then tightened in place. This provides an adjustably fixed connection between the arm 140 and the support bar 132, but a slidable connection between the arm 140 and the guide arm 122. A similar connection is provided between the support bar 132, the guide arm 120 and the heat sealing arm 138 by means of the set screw 154, which extends through a shim 156, and the arm 138, and is locked in place on the support bar 132 by means of a block similar to the block 142.

Each arm 138, 140 is provided at its upper end with a vertical pin, as at 158 and 160, and each of these pins is connected by means of a respective coil spring 162 and 164 to the end of a respective rod 166 and 168 which extend laterally from their respective blocks 108 and 110.

At the lower end of each arm 138, 140 is provided an insulating block, as at 170 and 172, to which is connected an electrically energized heat sealing blade, as at 174 and 176 respectively. Electrical wires, respectively shown at 178 and 180, leading to a source of electrical energy, not shown, are connected through the respective insulating blocks to the sealing blades.

Each arm 138, 140 is further provided with an angular cam edge at its upper portion, as shown at 182 and 184 respectively. These cam edges bear against the respective pins 128, 130, whereby when the support arm 132 is pushed downwardly, the cam edges 182, 184 will ride along their respective pins 128, 130 to cause the arms 138, 140 to pivot around their respective screws 154, 146, bringing the sealing blades 174, 176 into engagement with the edges of the bags as defined by the respective mating slots 28 and 92 and 94 and 30 on the platen 84 and guide plate 26.

As discussed above, the machine is adapted to operate on both single and double bag types of pads. For this purpose, as best shown in FIGS. 6 and 7, the tray support panels 16 and 18 are provided with a plurality of holes such as shown at 186 in panel 16 and at 188 in panel 18.

Figure 6:
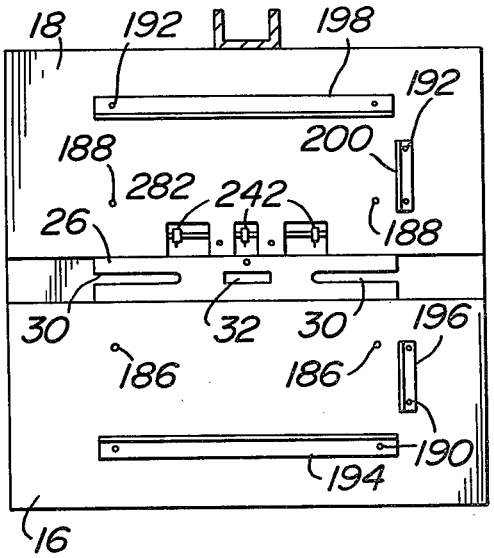
FIG. 6 is a top plan view of the machine having a double bag type top.
Figure 7:
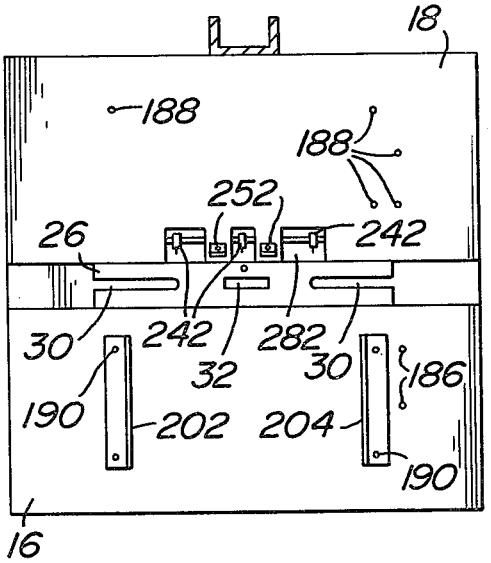
FIG. 7 is a top plan view similar to FIG. 6, but showing a single bag type top.

These holes are adapted to receive screws, bolts or any other desirable fastening means, such as shown at 190 in panel 16 and 192 in panel 18, which releasably fasten to the panels appropriate tray guides, such as shown at 194, 196 and 198, 200 in FIG. 6 and at 202, 204 in FIG. 7.

The guides 194, 196 on panel 16 and 198, 200 on panel 18, as shown in FIG. 6, are for guiding and supporting a double bag type tray, such as shown at 206 in FIG. 3, the guides 194, 198 supporting the edges 208, 210 of the tray while the guides 196, 200 act as stop means against the respective side walls 212, 214 of the tray, whereby side slots 216, 218 of the tray and central slot 220 of the tray mate with the corresponding slots in guide plate 26 and platen 84.

The guides 202 and 204, as shown in FIG. 7, are for guiding and supporting the single bag type tray such as shown at 222 in FIG. 4, the guides 202, 204 abutting the side walls 224, 226 of the tray. When used for single bag type trays, no guides are required on panel 18, as shown in FIG. 7. Although the use of trays is preferable, it is possible, within the scope of this invention, to just place the stack of bags, temporarily held together in any desirable fashion, between the guides.

The machine so far described is adapted to operate to produce double bag pads by placing the tray 206, with a stack of bag units 228, as shown in FIG. 3, or a stack of bags held together in any other fashion, between the guides shown in FIG. 6, and then operating the piston 56 for vertical downward movement. This causes the platen 84 to hold the bag units in place while the blade 76 punches the center slit 230 and the heat sealing blades form the side seals 232,234, as shown in FIG. 3. The vertical movement of the piston is timed in a manner well known in the art.

Single type bag pads preferably have end seals as well as the side seals for double type bag pads, these and seals forming additional reinforcement as well as providing additional anchor means which would otherwise be provided by the opposed bags in the double bag type. To obtain this type of construction the machine is provided with an end seal forming means, generally designated 240 and best shown in FIG. 2.

The end seal forming means 240 is preferably pivotally mounted underneath the top of the tray support panel 18, where it can be pivotally mounted into and out of operative position, and comprises one or more heat sealing elements (here shown as three in number), each comprising a heat sealing blade 242, which is mounted on an insulating block 244 and heated by electrical energy provided by wires 246 leading to a source of electrical energy (not shown). The three heat sealing elements are fixedly mounted on a transverse rod 248 which is, itself, fixidly mounted on a pair of rods 250 by means of blocks 252 connected thereto as by screws or the like.

The rods 250 extend through corresponding washers 253 on a plate 254 which is fastened by nut 256 to a piston having a piston rod 258 whose head is within a fluid cylinder 260 that is provided with fluid pressure lines 262 on opposite sides of the piston head within the cylinder. The rods 250 extend through apertures in a plate 264 connected to the cylinder and are each provided with a coil spring 266 bearing against the washer 253 on plate 254 at one end and the corresponding block 252 at the other end. These springs are of the heavy duty type, having sufficient strength to push the sealing blades into sealing position when the piston is moved forwardly and being adapted to cause overtravel of the heat sealing blades. Collars 268 are fixed to the rods 250 between the two plates 254 and 264.

A plate 270 is connected to the end of cylinder 260 and this plate is provided with a laterally extending pin 272 at each side. These pins are rotatably positioned in corresponding bearing blocks 274 attached to the underside of panel 18, whereby the entire assembly is pivotally mounted to swing down away from the panel 18 by gravity. In this manner, it is out of the way when the machine is operating on double bag type pads. However, when it is desired to operate on single bag type pads, the assembly 240 is swung up on its pivot and a laterally extending pin 275 is releasably held in place by a latch 276. The latch 276 is rotatably mounted on a set screw 278 and has a shoulder 280. When latching the pin 275 in place, the latch 276 is swung on its pivot to permit the pin 275 to be pushed against the underside of panel 18, then the latch is swung around to engage its shoulder 288 with the underside of pin 275, after which the set-screw 278 is tightened to hold the latch in place.

In the above-described upward position of the assembly 240 the heat seal blades 242 extend through notches 282 in the panel 18 into a position adapted to form end seals 284 (see FIG. 4), while the slit 286 and side seals 288 are being formed in the manner previously described. The blocks 252 act as stop means to position the edge 290 of the stack in the proper position during the slitting and heat sealing action.

FIG. 11 exemplifies a fluid circuit wherein cylinder 46 is connected to a three-way valve 292 by a line 294, and cylinder 260 is connected to the valve 292 through line 296. The cylinder 46 is also connected to a three-way valve 298 by line 300 while cylinder 260 is connected to valve 298 by a line 302.

When valve 292 is in one position, it opens flow to both cylinders 46 and 260 from a source of pressure fluid (not shown) through line 304 so that the pistons 56 and 258 act in conjunction. During this time, valve 298 is open to permit return flow through lines 300 and 302 to the source through a line 306. When only the piston 56 is to be used, the valve 292 is moved to a second position closing flow to cylinder 260, but maintaining it to cylinder 46. The valve 298 is then moved to a second position where the return flow is only through lines 300 and 306.

The valves may be manually operated or they may be operated by pivotal movement of the assembly 240 by any desired type of switch means or linkage such as would be within the skill of the art.

The vertically movable piston rod 56, although illustrated as being connected to the slitting blade 76, may, within the scope of this invention, be provided with another type of perforating means such as a hole punch or the like. It is also possible to eliminate any perforating means if it is not desired to provide a slit or other perforation in the bag pads and to merely use the piston for operating the side sealing elements. Furthermore, it is possible to substitute for the piston some other vertically movable means, such as, for example, a cam-operated shaft or similar device. In addition, although the use of heat sealing elements is preferable, it is possible to substitute other fastening means such as, for example, adhesive applicators, clamps, or the like.

Figure 8:
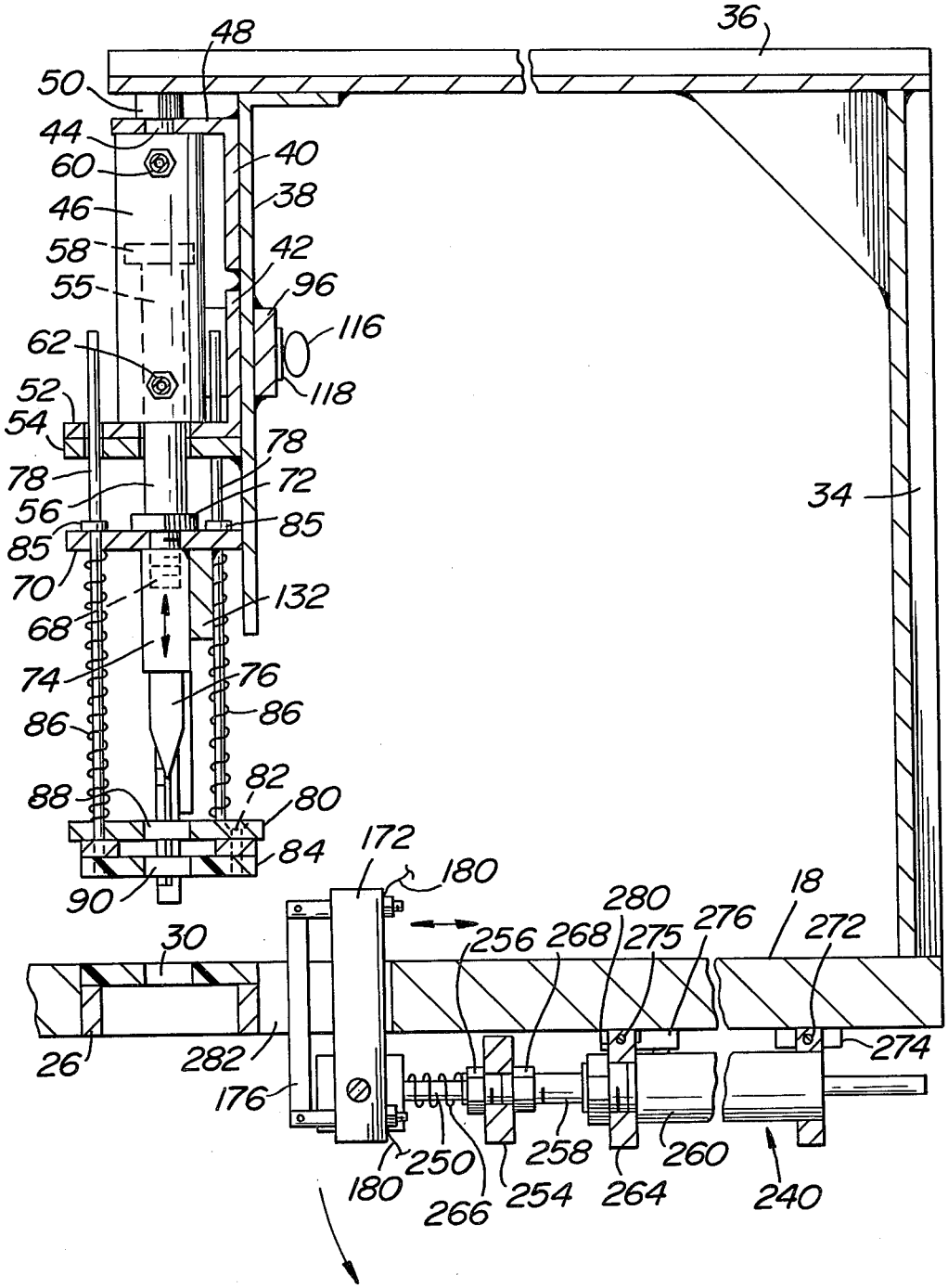
FIG. 8 is a cross-sectional view taken on line 8—8 of FIG. 5.

It is also to be understood that although the mechanism for performing the side sealing and perforating operations as, for example, shown in FIGS. 1, 5 and 8, is illustrated as being mounted above the tray supporting platform, it may equally well be mounted under the table while yet retaining the same vertically actuated functions. In such instance, the assembly 240, best shown in FIGS. 2 and 8, can either be mounted above the platform or totally eliminated together with its function.

The invention claimed is:

1. A bag pad binder comprising a table assembly which includes a support platform adapted to hold a stack of bag units in a predetermined position, support means connected to said table assembly and supporting a vertically-movable actuating means for vertical movement toward and away from said platform, and oppositely-disposed side sealing means operatively connected to said vertically-movable actuating means to move horizontally toward and away from each other while moving toward and away from a bag stack side sealing position in accordance with vertical movement of said vertically-movable actuating means.

2. The bag pad binder of claim 1 wherein said platform comprises oppositely-disposed panels separated by a slotted guide plate, said guide plate having a slot at each end adapted to receive and guide said side sealing means toward and away from said side sealing position.

3. The bag pad binder of claim 1 wherein said vertically movable actuating means supports a vertically movable perforating means movable toward and away from bag stack perforating position.

4. The bag bad binder of claim 1 wherein said vertically-movable actuating means is supported above said platform.

5. The bag pad binder of claim 1 wherein said vertically-moveable actuating means is supported below said platform.

6. The bag pad binder of claim 1 wherein said platform is provided with a predetermined pattern of apertures, said apertures being adapted to releasably engage securing means connected to bag stack guide means for releasably securing selected bag stack guide means to said platform.

7. The bag pad binder of claim 1 wherein a rear-edge sealing assembly is operatively connected to said table assembly, said rear-edge sealing assembly comprising at least one rear-edge sealing means horizontally movable toward and away from a rear-edge sealing position transversally to the direction of movement of said oppositely-disposed side sealing means but in synchronism therewith.

8. A bag pad binder comprising a table assembly which includes a bag stack support platform, said platform comprising oppositely-disposed panels separated by a slotted guide plate, said guide plate having opposed end slots and a central slot, support means connected to said table assembly and supporting said vertically-movable actuating means, said vertically-movable actuating means supporting a vertically-movable perforating means which is vertically movable into and out of said central slot upon vertical movement of said vertically-movable actuating means, and oppositely-disposed side sealing means operatively connected to said vertically-movable actuating means to move into and out of the respective end slots in accordance with vertical movement of said vertically-movable means.

9. The bag pad binder of claim 8 wherein a rear-edge sealing assembly is operatively connected to said table assembly, said rear-edge sealing assembly comprising at least one rear-edge sealing means horizontally movable transversely to the direction of movement of said oppositely-disposed heat sealing means, but in synchronism therewith, toward and away from an edge sealing position.

10. A bag pad binder comprising a table assembly which includes a bag stack support platform adapted to hold stacked bag units in a predetermined position, said platform comprising oppositely-disposed panels separated by a slotted guide plate, said guide plate having end slots and a central slot, support means connected to said table assembly and supporting vertically-movable actuating means, said actuating means being connected to a vertically-movable perforating means that is vertically movable into and out of said central slot upon vertical movement of said actuating means, oppositely-disposed side sealing means operatively connected to said actuating means to move into and out of the respective end slots in accordance with vertical movement of said actuating means, and a rear-edge sealing assembly comprising at least one rear-edge sealing means horizontally movable transversely to the direction of movement of said oppositely-disposed side sealing means, but in synchronism therewith, toward and away from a rear-edge sealing position.

11. The bag pad binder of claim 10 wherein said platform is provided with at least one slot adapted to removably receive a corresponding edge sealing means when said edge sealing means is in operative sealing position.

12. The bag pad binder of claim 10 wherein said edge sealing assembly is hingedly connected to the underside of said platform to hingedly move into and out of operative sealing position relative to said platform, and latch means for releasably securing said edge sealing assembly in said operative position.

13. The bag pad binder of claim 10 wherein said oppositely-disposed sealing means comprise a pair of sealing arms one on each side of a horizontal support bar, said support bar being connected to the vertically-movable actuating means, said sealing arms being both longitudinally adjustable and pivotally connected to said support bar, and means for pivoting said arms in conjunction with vertical movement of said support bar.

14. The bag pad binder of claim 13 wherein said means for pivoting said arms comprise cam edges on said arms in coacting arrangement with corresponding cams connected to said support bar.

* * * * *